US005900580A

United States Patent [19]

Beisswenger et al.

[11] Patent Number: 5,900,580

[45] Date of Patent: May 4, 1999

[54] EXPLOSIVE PROJECTILE

[75] Inventors: Roland Beisswenger, Eckental; Hans Strauss, Reichenschwand; Adolf Bankel, Uttenreuth; Hans Pauly, Röthenbach; Stephen Kerk, Schnaittach, all of Germany

[73] Assignee: Diehl Stiftung & Co., Nürnberg, Germany

[21] Appl. No.: 08/884,402

[22] Filed: Jun. 27, 1997

[30] Foreign Application Priority Data

Jul. 3, 1996 [DE] Germany ..... 196 26 660

[51] Int. Cl.[6] ..... F42B 12/04; F42B 12/20; F42B 12/32

[52] U.S. Cl. ..... 102/494; 102/473; 102/517

[58] Field of Search ..... 102/389, 473, 102/476, 491–497, 517

[56] References Cited

U.S. PATENT DOCUMENTS

| | | | |
|---|---|---|---|
| H1235 | 10/1993 | Canaday . | |
| 647,546 | 4/1900 | Warren | 102/494 |
| 1,181,190 | 5/1916 | Welton . | |
| 4,351,239 | 9/1982 | McCubbin et al. | 102/493 |
| 4,524,696 | 6/1985 | Altenau et al. | 102/491 |
| 4,882,996 | 11/1989 | Bock et al. | 102/494 |
| 5,261,629 | 11/1993 | Becker et al. | 102/496 |
| 5,565,648 | 10/1996 | Lindstadt et al. | 102/476 |
| 5,661,254 | 8/1997 | Steuer et al. | 102/494 |

FOREIGN PATENT DOCUMENTS

| | | | |
|---|---|---|---|
| 0 101 795 | 5/1983 | European Pat. Off. . | |
| 29 47 165 C2 | 11/1979 | Germany . | |
| 32 24 704 A1 | 7/1982 | Germany . | |
| 3149430 | 8/1982 | Germany | 102/491 |
| 3424238 | 1/1986 | Germany | 102/493 |
| 37 03 773 A1 | 2/1987 | Germany . | |
| 37 36 842 A1 | 10/1987 | Germany . | |
| 38 22 375 A1 | 7/1988 | Germany . | |

*Primary Examiner*—Harold J. Tudor
*Attorney, Agent, or Firm*—Scully, Scott, Murphy & Presser

[57] ABSTRACT

An explosive projectile (10) with a projectile casing (12), a ballistic hood (14), an explosive charge (26) located within of the projectile casing (12), a base detonator (28) and a fragment packing (32) which is located towards the head end of the projectile. The ballistic hood (14) is constructed so as to be readily destroyable or, respectively, constituted of a readily destroyable material. The projectile casing is closed at its forward end and provided with a recess (30) in which there is arranged the fragment packing (32). The fragment packing (32) at the forward end thereof bounds the explosive charge (26).

5 Claims, 2 Drawing Sheets

EXPLOSIVE PROJECTILE

BACKGROUND OF THE INVENTION

1. Field of the Invention

The present invention relates to an explosive projectile which includes a projectile casing, a ballistic hood arranged at the forward end of the projectile casing, an explosive charge located in the interior of the projectile casing, a base detonator for the triggering of the explosive charge, and a packing of fragments which is arranged at the head end of the projectile.

2. Discussion of the Prior Art

From the disclosure of German Patent Specification DE 29 47 165 C2 there has become known an arrow-shaped or slender armor-penetrating projectile with a penetrator head, which consists of a head penetrator body, a main penetrator body and a tubular connecting piece which interconnects these aforementioned bodies. The connecting piece maintains the main penetrator body at an axial spacing from the head penetrator body. The connecting piece can be constituted of a plastically deformable material and form a jacket which bounds a space in which there are arranged scatter projectiles constituted of a compact material. The scatter projectiles preferably embedded in a binder medium which can be formed from paraffin, wax or an explosive material.

The disclosure of European EP O 101 795 A1 describes an explosive projectile with a projectile casing in which there are supported preformed fragmentation bodies. Arranged at the head end thereof is a detonator. In order to improve the fragmentation effect in a spatial angular region or cone which is located directly ahead of the projectile head, this known explosive projectile there are also provided additional fragmentation bodies in the head detonator. These fragmentation bodies are located in a rearward portion of the head detonator, the latter of which can project into the explosive charge of the explosive projectile. The fragmentation bodies encompass an intermediate charge which pyrotechnically interconnects in an annulus-shape a transfer charge which is provided in a safe-and-arm arrangement with a booster charge.

From the disclosure of German Patent Specification DE 3 822 375 A1 there is known an explosive charge or, respectively, a detonation body which possesses an explosive charge and a layer of fragments. The fragment layer consists of an explosive body with such types of wall weakenings that, upon the detonation of the explosive charge, it will burst apart into loose fragments. The fragment layer in this known detonation body is encompassed by an inner and an outer protective layer.

SUMMARY OF THE INVENTION

Accordingly, it is an object of the present invention to provide an explosive projectile of the above-mentioned type whose effectiveness in a target which is to be attacked is improved through the presence of directed or oriented fragments in the forward projectile region.

The foregoing object is inventively achieved in an explosive projectile of the above-mentioned type that a ballistic hood of the projectile is constructed so as to be easily destroyable and/or consists of an easily destroyable material, and wherein the projectile casing is constructed so as to be closed at its forward end and with a cutout or recess in which there is arranged the packing of fragments, which at its forward end bounds against the explosive charge.

Further advantages and modifications of the invention explosive projectile can be ascertained from the following detailed description.

The inventive explosive projectile evidences the advantage that its effectiveness in a target which is to be attacked can be improved through oriented or directed fragments; in essence, the fragments which are necessary in the axial direction of the explosive projectile, in effect, the fragments in the forward projectile region are realized through the inventive packing of fragments which at its forward end bounds the explosive charge.

BRIEF DESCRIPTION OF THE DRAWING

Exemplary embodiments of the inventive explosive projectile are now described in connection with the drawings shown in a partially cross-sectional representation; in which.

DETAILED DESCRIPTION OF A PREFERRED EMBODIMENT

Figure 1:
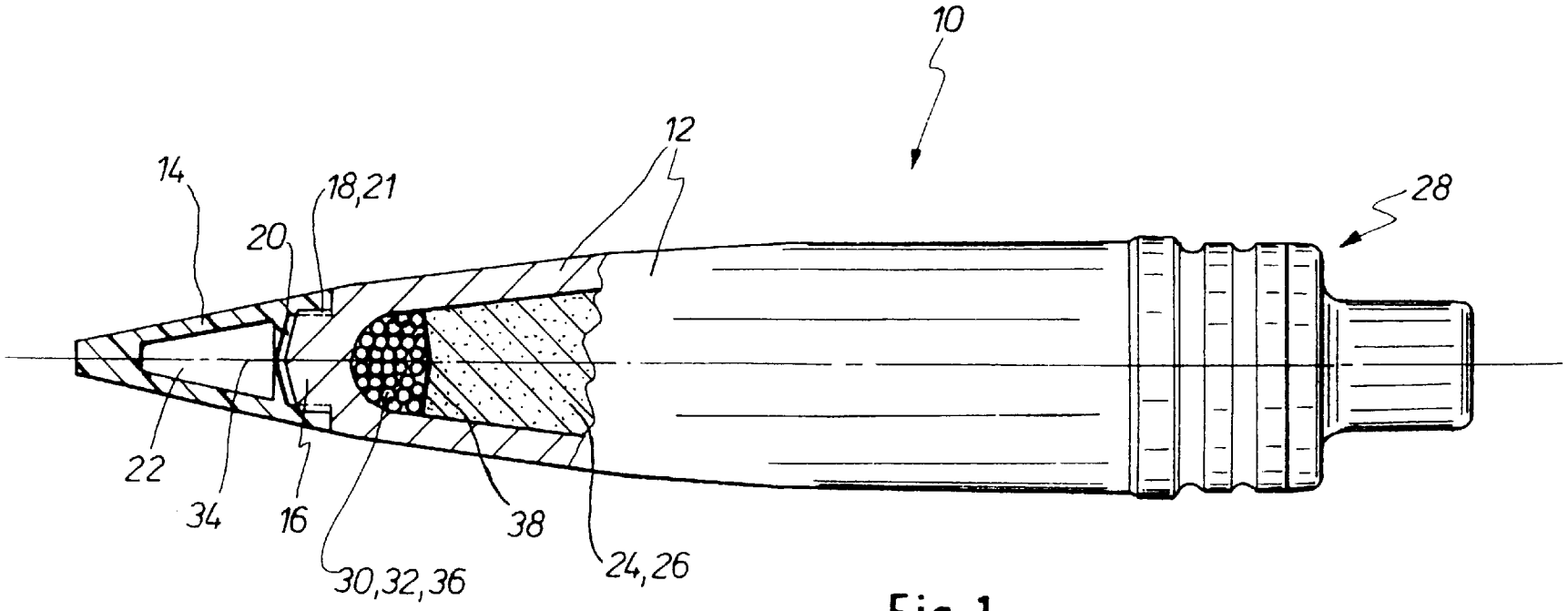
FIG. 1 illustrates a first embodiment of the invention.

FIG. 1 of the drawings illustrates an explosive projectile 10 having a projectile casing 12, and with a the ballistic hood 14 which is attached on the forward end of the projectile casing 12. For this purpose, the projectile casing 12 is formed at its forward end with a central projection 16 which is provided with an external screwthread 18. The ballistic hood 14 formed with a central recess 20 which is provided with an internal screwthread 21 adapted to mate with the external screwthread 18. The ballistic hood 14 preferably consists of a plastic material, and is formed with a central hollow space 22.

Arranged in the interior 24 of the projectile casing 12 is an explosive charge 26, which is triggered by means of a base detonator 28.

Figure 2:
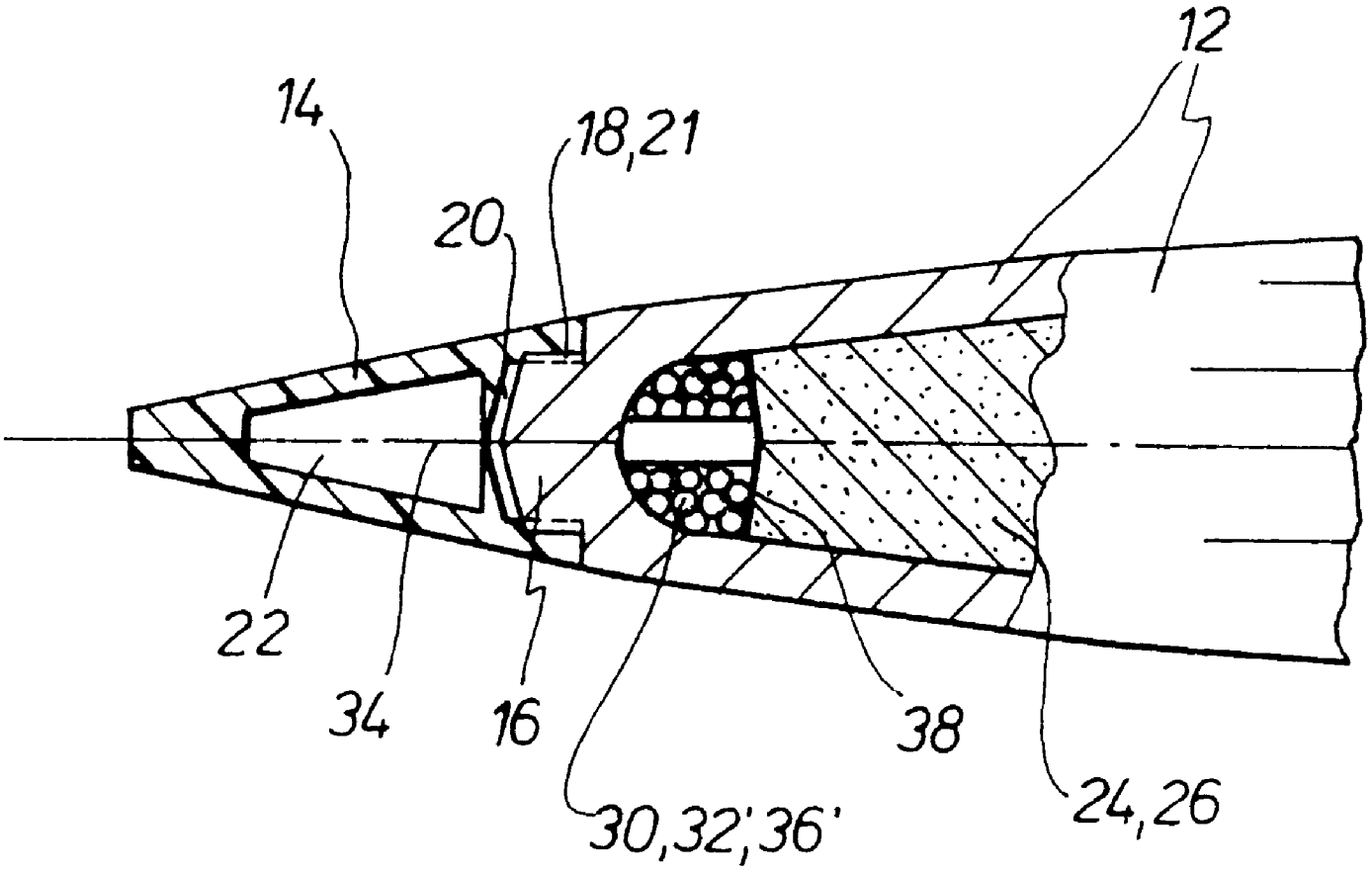
FIG. 2 illustrates a modified embodiment of FIG. 1.

The projectile casing 12 is constructed so as to be closed at its forward end and provided with a recess 30 in which there is located a packing of fragments 32. The fragment packing 32 at its forward end bounds the explosive charge 26. The fragment packing 32 of FIG. 1 maybe alternatively formed as a multilayered ring-shaped or annular packing 32', in FIG. 2, which is centered relative to the longitudinal center axis 34 of the explosive projectile 10. It is equipped with a foam embedding 36, in FIG. 1, and with a foam embedding 36' as shown in FIG. 2.

In the drawings there are represented fragment packings 32 or 32' which are formed of spheres or balls. The fragment packing 32 or 32' can, however, also be formed from cubes or otherwise configured bodies. It is separated from the explosive charge 26 by means of a thin disk or plate element 38 which is constructed so as to widen forwardly in a cone-shape possessing a relatively flat or obtuse angle. The disk element 38; for example, consists of a felt material, of aluminum, or the like. The functioning of the explosive projectile 10 is also obtained in the absence of the disk element 38.

The fragment packing 32 or 32' is provided either as foamed, prefinished components which are inserted into the projectile casing 12, or the embedding in foam 36 or 36" is implemented directly at the intended position in the projectile casing 12.

What is claimed is:

1. An explosive projectile comprising a projectile casing (12); a hollow ballistic hood (14) constructed of a plastic material being located at a forward end of the projectile casing (12), said ballistic hood having a central hollow space (22), an explosive charge (26) located within the projectile casing, a base detonator (28) for the triggering of the explosive charge (26), and a fragment packing (32) located at a head end of the projectile, the projectile casing (12) being closed at the forward end thereof and provided with a recess (30) at said forward end in which there is arranged the, fragment packing (32), said fragment packing (32) extending circumferentially within an annular wall surface of said recess (30), and foam material (36) embedding said fragment packing (32), said foam embedded fragment packing (32, 36) having a rearward end which bounds a forward end of the explosive charge (26) while separated therefrom through the interposition of a disk element (38).

2. An explosive projectile according to claim 1, wherein the fragment packing (32) is formed in multiple layers.

3. An explosive projectile according to claim 2, wherein the fragment packing (32) is prefinished.

4. An explosive projectile according to claim 1, wherein the fragment packing (32) is selectively formed of spheres or cubes.

5. An explosive projectile according to claim 1, wherein the fragment packing (32) is formed as a multi-layered centered annular packing.

* * * * *